United States Patent [19]

Wieloch

[11] 4,189,643

[45] Feb. 19, 1980

[54] TREATMENT OF PAPER FOR IMPROVED ELECTROSTATOGRAPHIC FUSING

[75] Inventor: Francis J. Wieloch, Penfield, N.Y.

[73] Assignee: Xerox Corporation, Stamford, Conn.

[21] Appl. No.: 841,268

[22] Filed: Oct. 5, 1977

[51] Int. Cl.[2] ..... H01T 19/04

[52] U.S. Cl. ..... 250/326; 250/315.2

[58] Field of Search ..... 250/324, 325, 326, 315 A

[56] References Cited

U.S. PATENT DOCUMENTS

| | | | |
|---|---|---|---|
| 3,113,208 | 12/1963 | Traver | 250/324 |
| 3,132,246 | 5/1964 | Mosher et al. | 250/324 |
| 3,757,163 | 9/1973 | Gibbons et al. | 250/324 |
| 3,960,556 | 6/1976 | Griesmer | 250/326 |

*Primary Examiner*—Harold A. Dixon

*Attorney, Agent, or Firm*—Ernest F. Chapman

[57] ABSTRACT

Disclosed is a method of treating a paper sheet comprised of a mat of paper making fibers having a uniform coating of starch or modified starch on its surface to improve its performance in electrostatographic copiers. The treatment involves exposing such a sheet having a smooth surface to a direct stream of corona ions. This treatment results in improved adhesion of toner to the sheet when it is used as the receiving member in an electrostatographic copier.

4 Claims, No Drawings

TREATMENT OF PAPER FOR IMPROVED ELECTROSTATOGRAPHIC FUSING

BACKGROUND OF THE INVENTION

This invention relates to plain paper electrostatographic copying, and more specifically, to a method of treating paper used in this process to enhance the adhesion of toner thereto.

The art of electrostatographic copying involves the use of a photoconductive element or plate which is uniformly electrostatically charged in order to sensitize its surface. The plate is then exposed in an imagewise manner to activating electromagnetic radiation which selectively dissipates the charge in the exposed areas of the photoconductive material while leaving behind a latent electrostatic image in the non-exposed areas. This latent, electrostatic image may then be developed by depositing a finely divided electroscopic marking material known as toner on the surface of the photoconductive plate. Transfer of the toner from the plate to a receiving member such as plain paper, with subsequent thermal fusing of the toner into the paper, results in a permanent copy.

One method of fusing the toner particles into the paper is known as roll fusing wherein the paper is contacted under pressure with a heated fuser roll. Roll fusing, as contrasted with radiant fusing, has the advantages of lower power requirements, faster output and the ability to fuse both sides of the paper which is essential when copying in the duplex mode.

It is preferred to keep the temperature of the heated roller as low as possible in order to keep problems such as scorching, paper curl, etc. associated with high roller temperatures to a minimum. Of course, the roller temperature must not be reduced to such a low level that the fusing efficiency is affected. Accordingly, it would be desirable and it is an object of the present invention to improve the efficiency of the aforementioned fusing operation to thereby permit efficient fusing at reduced temperatures.

SUMMARY OF THE INVENTION

The present invention is a method of treating a paper sheet comprised of a mat of paper making fibers having a smooth, uniform coating of starch or a modified starch on its surface. The surface of the paper sheet is exposed to a direct stream of corona ions to improve its performance as a receiving member in electrostatographic copiers. The corona treatment of the paper sheet, prior to imaging it in an electrostatographic copier, enhances the ability of the copier's roll fuser to cause the permanent adhesion of toner particles to the surface of the paper sheet.

DETAILED DESCRIPTION AND PREFERRED EMBODIMENTS

The paper sheets useful in the present invention comprise a substrate of paper making fibers which has been coated with a layer of starch or a starch derivative to form a smooth surface. Typical paper making fibers comprise cellulose derived from wood, sugar cane, rags, etc. The sheets are typically coated or "surface sized" with starch to provide controlled wetting of the paper with ink and thereby avoid blotting when the paper is imaged.

Paper sheets useful in the present invention are selected from those whose outer surface comprises a smooth, uniform layer of starch. After selection of the particular paper sheet to be imaged, the surface of the sheet is subjected to a high voltage, direct current corona discharge, e.g. from a corotron wire, a scorotron device, or an array of closely spaced, sharp corona emitting points. Such devices are well known, and are described by Dessauer and Clark in *Xerography and Related Processes,* New York, Focal Press, 1965. When raised to an appropriate voltage, for example, 4 to 10 kilovolts, such devices share the ability to emit corona ions as a glow discharge across an air gap.

The corona electrode is conveniently provided in the form of a corotron, i.e. a grounded metal shield having blocks of an insulating material at each end, one of the blocks being modified with a probe extending from it. A wire is suspended between the two insulating blocks and electrically connected to a metal pin in the probe. The wire is held parallel to the sides of the shield by its mounting hardware. In operation, the corotron is placed in close proximity (but not in contact with) the paper sheet. The corotron can be set to produce a cloud of either negative or positive corona ions. When positive ions are desired, a strong positive potential is placed on the corotron wire. This positive charge causes electrons to move to the inner surface of the shield from ground, and as electrons move to the inner surface, the electrostatic field intensifies between the shield and the wire. Air contains a number of free electrons which are pulled toward the wire. As the electons accelerate, they collide with air molecules and thereby displace electrons to form positive ions. The displaced electrons, in turn, collide with other atoms, and the process is repeated until the area around the wire is saturated with positive ions. The movement of the positive ions of air is from the wire towards the shield or any grounded surface close to the corotron which, in the case of the present invention, is the paper sheet being treated.

As the positive ions come in contact with the shield or grounded surface, they acquire electrons and this charge is neutralized. The electron path or flow is from ground to the ion cloud to the corotron wire back to the power supply. More current flow from the shield to the corotron wire than from the grounded plate to which the charge is being applied. This heavy current between the wire and the shield is necessary if the desired output of the corotron, which is a uniform cloud of ions, is to be achieved. This design also insulates the ion current to the wire from sudden changes caused by an external electrostatic field.

When negative voltage is applied to the wire, electrons are emitted, forming negative ions. Movement of negative ions is from the wire to the shield or any grounded surface.

The paper sheet to be treated is placed on a grounded surface and exposed to the ion cloud emitted from the corotron.

It has been discovered that the previously described corona treatment of paper enhances the adhesion of xerographic toner thereto. It is known to corona treat plastic films, e.g. polyethylene, to improve ink adhesion thereto. This concept is disclosed in U.S. Pat. No. 3,132,246. The present method is, however, quite distinct from this prior art method. This is the case because the starch coated papers contemplated for use in the present invention are chemically dissimilar from the plastic sheets disclosed in U.S. Pat. No. 3,132,246. Furthermore, xerographic toner, which is comprised of discrete particles of a thermoplastic resin and a coloring agent, is quite dissimilar, both chemically and physically, from the liquid inks of U.S. Pat. No. 3,132,246.

The method of practicing the present invention is further disclosed by the following examples.

EXAMPLE I

Paper sheets are corona treated in a Lepel treater (Model HFSG-2) which is a high frequency spark generator with electrodes about 1/16 inch away from the surface being treated. The paper sheets to be tested are taped to a roll of film and passed under the Lepel treater at a rate of approximately 10 ft./min. Treated and non-treated sheets from the same reams are imaged on a Xerox 3600 copier/duplicator and tested for degree of toner adhesion by use of the Taber abrader. Taber cycles are determined by abrading the image in a cyclic manner and determining how many cycles are required to rub a predetermined portion of the image off. The test is stopped when a photocell indicates a 20% drop in image density. High Taber cycles indicate better fusing of the images. Four types of paper are tested. The results are as follows:

| Paper | Taber Cycles | |
|---|---|---|
| | Treated | Not Treated |
| Lightweight (12 lb.) xerographic paper-starch coating | 23 | 15 |
| 20 lb. dual purpose sheet for xerographic and offset use-starch coated | 14 | 11 |
| 20 lb. No. 1 grade (high brightner content) xerographic paper-starch coated | 35 | 24 |
| 20 lb. archival grade xerographic paper-20% cotton | 12 | 13 |

Three of the four papers show increased Taber cycles. The archival grade paper shows no real change. The three papers which show improvement have smooth surfaces whereas the archival paper has a rough "cockle" finish.

EXAMPLE II

Three papers are selected for corona treatment. These are Xerox 1024, 4024DP(I) and 4024DP(II). The 1024 and 4024DP(I) papers are selected as being typical of paper commercially used in electrostatographic copiers. The 4024DP(II) is selected because this paper has been found somewhat difficult to fuse in certain electrostatographic copiers.

Twenty-five sheets of each paper are corona treated on the felt side, i.e. the side to be imaged. This is accomplished by taping the sheets to a roll of film, and passing it under the Lepel Treater at approximately 5 ft./min.

The Lepel HRSD-2 Treater conditions are as follows:

100 Watts
0.45 Amps
Power Range 4
Vernier Control 1
Tuning—7
4 Treater Bars—First 2 bars are ¼ inch above roll surface, last 2 bars are ⅛ inch above roll surface.

Sixteen of the treated sheets of each type of paper are marked and randomly placed in a ream of untreated sheets of the same type. The treated and untreated sheets of each type are imaged, about 3 hours after corona treating, on a Xerox 9200 duplicator using a fuser roll temperature of 340°-344° F.

In order to determine the fix level of the images, four sheets of treated and four sheets of untreated paper are tested for each of the three types. The fixing levels are judged A, B, C or D based on comparing the sheets with standard patterns after a 10 Taber cycle abrasion test. Three separate judges are assigned to grade each paper. The results of these tests are set out in Table I.

TABLE I

| | 1024 Paper | | 4024DP(I) Paper | | 4024DP(II) Paper | |
|---|---|---|---|---|---|---|
| | Untreated | Treated | Untreated | Treated | Untreated | Treated |
| Judge #1 | B− | B+ | C+ | B− | C+ | C+ |
| | B | B+ | C+ | B− | C+ | C+ |
| | B | B+ | C+ | B− | C | C+ |
| | B− | B+ | C+ | B− | C | B− |
| Avg. | B+,B | B+ | C+ | B− | C,C+ | C+,B− |
| Judge #2 | B | B | C | B | B | B |
| | B | A | C | B | C | C |
| | B | B | C | B | B | B |
| | B | B | C | B | C | B |
| Avg. | B | B+ | C | B | C+,B− | B− |
| Judge #3 | B | B | C | B | C | B |
| | B | B | C | B | C | B |
| | B | B | C | B | C | B |
| | B | B | C | B | C | B |
| Avg. | B | B | C | B | C | B |

The fusing results indicate an increase in fusing quality of the treated papers. There is general agreement on the fusing among the judges. With the fuser roll temperature set at a marginal condition, the corona treated samples are fused to a greater degree than the untreated samples. It is estimated that the corona treating of the papers produced equivalent fused images as untreated papers fused at a 10°-15° F. increase in fuser roll temperature.

What is claimed is:

1. A method of treating a paper sheet comprised of a mat of paper making fibers having a smooth, uniform coating of starch or modified starch on its surface to improve the sheet's performance in electrostatographic copiers by enhancing the ability of the copier's roll fuser to cause the permanent adhesion of toner particles to the surface of the sheet, which method comprises exposing the surface of the paper sheet to a direct stream of corona ions prior to imaging the sheet in the electrostatographic copier.

2. The method of claim 1 wherein the paper making fibers are derived from wood, sugar cane or rags.

3. The method of claim 1 wherein the corona ions are positively charged.

4. The method of claim 1 wherein the corona ions are negatively charged.

* * * * *